US009679689B2

(12) United States Patent
Underwood

(10) Patent No.: US 9,679,689 B2
(45) Date of Patent: Jun. 13, 2017

(54) MAGNETIC CLAMPING DEVICE FOR MAGNETICALLY CLAMPING TO A MAGNETICALLY ATTRACTED MATERIAL AND HAVING A DAMPENING MEANS

(71) Applicant: Perry John Underwood, Lake Cathie (AU)

(72) Inventor: Perry John Underwood, Lake Cathie (AU)

( * ) Notice: Subject to any disclaimer, the term of this patent is extended or adjusted under 35 U.S.C. 154(b) by 0 days.

(21) Appl. No.: 14/779,314

(22) PCT Filed: Mar. 24, 2014

(86) PCT No.: PCT/AU2014/000305
§ 371 (c)(1),
(2) Date: Sep. 22, 2015

(87) PCT Pub. No.: WO2014/146176
PCT Pub. Date: Sep. 25, 2014

(65) Prior Publication Data

US 2016/0078989 A1 Mar. 17, 2016

(30) Foreign Application Priority Data

Mar. 22, 2013 (AU) ..... 2013901011

(51) Int. Cl.
*H01F 7/02* (2006.01)
*H01F 7/04* (2006.01)
(Continued)

(52) U.S. Cl.
CPC ..... *H01F 7/0257* (2013.01); *B25B 5/003* (2013.01); *B25B 11/002* (2013.01); *H01F 7/0263* (2013.01); *H01F 7/04* (2013.01)

(58) Field of Classification Search
CPC ..... H01F 7/0257; H01F 7/0263; H01F 7/04; B25B 5/003; B25B 11/002
See application file for complete search history.

(56) References Cited

U.S. PATENT DOCUMENTS 6,471,273 B1 10/2002 Friedrich et al.
7,850,142 B2 * 12/2010 Sladojevic ..... B25B 11/002 249/219.1
(Continued)

FOREIGN PATENT DOCUMENTS

WO 9938726 A1 8/1999

OTHER PUBLICATIONS

International Search Report and Written Opinion related to PCT/AU2014/000305, mailed on Jun. 23, 2014.
(Continued)

*Primary Examiner* — Bernard Rojas
(74) *Attorney, Agent, or Firm* — Flener IP Law; Zareefa B. Flener

(57) ABSTRACT

There is provided a magnetic clamping device (10) for magnetically clamping to a magnetically attracted material (30). The device comprises at least one permanent clamping magnet (14, 44) for magnetically clamping to the magnetically attracted material wherein the magnet is movable relative to the magnetically attracted material from a position remote from the magnetically attracted material to a clamping position for the clamping of the material by the magnet. The device also includes damping means (22, 24) for damping the movement of the clamping magnet to the clamping position. The damping means biases the clamping magnet away from the magnetically attracted material to assist release of the clamping magnet from the magnetically attracted material. In addition, the device has support means (16, 40, 58) to which the clamping magnet is mounted for the relative movement of the clamping magnet from the remote position to the clamping position and for withdrawing the clamping magnet relative to the magnetically attracted material to release the magnetically attracted material. There is also provided a method for clamping the
(Continued)

magnetically attracted material (30) using the clamping device (10). The clamping device may, for example, be a device for securing a load to the magnetically attracted material, a lifting device, a device for holding a work piece in position, or a welding clamp.

22 Claims, 10 Drawing Sheets

(51) Int. Cl.
*B25B 11/00* (2006.01)
*B25B 5/00* (2006.01)

(56) References Cited

U.S. PATENT DOCUMENTS

| | | | | |
|---|---|---|---|---|
| 8,446,242 | B2 * | 5/2013 | Harjes | H01F 7/0257 269/8 |
| 2007/0040092 | A1 | 2/2007 | Von Limburg | |
| 2010/0213657 | A1 | 8/2010 | Sladojevic | |
| 2010/0237969 | A1 | 9/2010 | Crawshaw | |
| 2010/0328001 | A1 | 12/2010 | Harjes | |
| 2011/0073118 | A1 | 3/2011 | Ponsort et al. | |
| 2013/0222090 | A1 | 8/2013 | Haritou et al. | |

OTHER PUBLICATIONS

European Search Report (from EPO) for EP14770921 (related application); completed Dec. 1, 2016.

* cited by examiner

MAGNETIC CLAMPING DEVICE FOR MAGNETICALLY CLAMPING TO A MAGNETICALLY ATTRACTED MATERIAL AND HAVING A DAMPENING MEANS

FIELD OF THE INVENTION

The present invention relates to a device for magnetically clamping to a magnetically attracted material and to methods for use of the clamping device.

BACKGROUND TO THE INVENTION

A range of magnetic latching devices utilising permanent magnets are conventionally known and find application in domestic settings as latches for cabinet and cupboard doors. Permanent magnets have also been utilised in magnetic couplings, and magnetic lifting, securing and clamping devices. Various types of rare earth magnets are nowadays readily commercially available. Rare earth magnets are strong permanent magnets and it can difficult to separate them from one another or from ferromagnetic materials due to the significant attractive forces they can exert.

Magnetic clamping devices are, for example, described in International Patent Application No. PCT/AU99/00070 (Publication No. WO 99/38726). That patent application relates to a device for securing a load to a motor vehicle, in which one of more permanent magnets are provided within a housing and are arranged to be raised or lowered with the rotation of a handle. The handle is in the form of an enlarged head of a bolt that protrudes from the housing and the permanent magnet(s) are alternatively lowered to magnetically clamp the device in position on the motor vehicle or raised to release the device there from, as the bolt is screwed into or out of the housing. However, screwing the handle to operate the device places a twisting force on the wrist of the user and the force required to overcome the clamping attraction of the permanent magnet(s) to the vehicle exacerbates strain placed on the wrist.

SUMMARY OF THE INVENTION

In an aspect of the invention there is provided a magnetic clamping device for magnetically clamping to a magnetically attracted material, comprising:

at least one permanent clamping magnet for magnetically clamping to the magnetically attracted material, the magnet being movable relative to the magnetically attracted material from a position remote from the magnetically attracted material to a clamping position for the clamping of the material by the magnet;

damping means for damping the movement of the clamping magnet to the clamping position, the damping means biasing the clamping magnet away from the magnetically attracted material to assist release of the clamping magnet from the magnetically attracted material; and support means to which the clamping magnet is mounted for said relative movement of the clamping magnet from the remote position to the clamping position and for withdrawing the clamping magnet relative to the magnetically attracted material to release the magnetically attracted material.

In another aspect of the invention there is provided a method for clamping a clamping device to a magnetically attracted material, comprising:

(1) providing the clamping device, the device having:

(a) at least one permanent clamping magnet for magnetically clamping to the magnetically attracted material, the magnet being movable relative to the magnetically attracted material from a position remote from the magnetically attracted material to a clamping position for the clamping of the material by the magnet;

(b) damping means for damping the movement of the clamping magnet to the clamping position; and (c) support means to which the clamping magnet is mounted for said relative movement of the clamping magnet from the remote position to the clamping position and for withdrawing the clamping magnet relative to the magnetically attracted material to release the magnetically attracted material;

(2) locating the clamping device in position in relation to the magnetically attracted material; and (3) magnetically clamping the magnetically attracted material with movement of the clamping magnet relative to the magnetically attracted material from said remote position to the clamping position, the damping means biasing the clamping magnet away from the magnetically attracted material to assist release of the clamping magnet from the magnetically attracted material.

Typically, the damping means comprises repelling magnets arranged for being moved relative to one another into a magnetically repelling relationship with each other to dampen the movement of the clamping magnet into the clamping position.

Typically, the repelling magnets comprise at least one moveable permanent magnet and at least one fixed permanent magnet, the moveable magnet being arranged to be moved into the magnetic repelling relationship with the fixed magnet with said movement of the clamping magnet relative to the magnetically attracted material.

The support means may be arranged for said movement of the clamping magnet from the remote position to the clamping position by magnetic attraction of the clamping magnet for the magnetically attracted material.

In at least some embodiments the support means comprises a ram operable to withdraw the clamping magnet relative to the magnetically attracted material for release of the magnetically attracted material from the clamping magnet.

In other embodiments the support means comprises a clamping lever rotatable about a pivot axis from a release position to a working position for clamping of the magnetically attracted material by the clamping magnet.

A device embodied by the invention can also comprise a lever arm for being manually pivoted about an axis of rotation from a release position to a working position for rotation of the clamping lever about its pivot axis to move the clamping magnet to its clamping position.

The arm can be connected to the clamping lever by a linkage. In other embodiments an actuator can be disposed on the the arm and arranged for being driven along the clamping lever for operation of the clamping lever.

In at least some embodiments, the device comprises a housing and the fixed permanent of the repelling magnets can be mounted to the housing or if provided, to the lever arm.

In embodiments in which the support means is a said clamping lever, the clamping magnet can be mounted to one end region of the clamping lever and the moveable magnet can be mounted to an opposite end region of the clamping lever.

In at least some embodiments a device embodied by the invention may comprise at least one further lever and at least one further said permanent clamping magnet mounted to the further lever, the further lever being rotatable by operation of the clamping lever to move the further clamping magnet from a position remote from the magnetically attracted material to a clamping position to magnetically clamp the magnetically attracted material.

The further lever can be arranged for being manually depressed for return of the further lever about its pivot axis.

Typically, a clamping device embodied by the invention further comprises a locking mechanism for being operated to lock the at least one said clamping magnet in its said clamping position.

The term "magnetically attracted material" as used herein is to be taken to encompass any solid material attracted by a magnetic field. Typically, the material is a ferromagnetic material such as iron or steel (e.g., mild steel), or a metal alloy attracted by the magnetic field of the permanent clamping magnet(s) of the clamping device.

Clamping devices embodied by the invention may for example be selected from securing devices for securing a load to the magnetically attracted material/metal substrate (e.g., of a metal work bench or motor vehicle), lifting devices (e.g., for lifting a load using physical labour or employing a crane), devices for holding work pieces or other items, and welding earth clamps. However, it will be understood that clamping devices in accordance with the invention have a wide variety of applications and different forms of the devices can be provided to suit the particular application(s) for which they are to be used.

Advantageously, the damping means of a clamping device embodied by the invention "cushions" the movement of the permanent clamping magnet(s) into position to magnetically clamp the device to whatever metal substrate on which the device is placed in use, thereby avoiding or reducing any uncontrolled "snapping" of respective of the clamping magnet(s) into their clamping position. Further, the damping means assists withdrawal of the clamping magnets from their clamping positions to release the clamping device from the metal substrate by acting in opposition to the magnetic attraction between the clamping magnet and the metal substrate. As such, the clamping magnets may clamp to the metal substrate strongly but still be released from the metal substrate with relative ease.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers, integers or steps.

Any discussion of documents, acts, materials, devices, articles or the like that has been included in this specification is solely for the purpose of providing a context for the invention. It is not to be taken as an admission that any or all of these matters form part of the prior art base or were common general knowledge in the field relevant to the invention as it existed in Australia or elsewhere before the priority date of this application.

The features and advantages of the invention will become further apparent from the following detailed description of non-limiting embodiments thereof read in conjunction with the accompanying drawings.

BRIEF DESCRIPTION OF THE ACCOMPANYING DRAWINGS

Figure 3A:
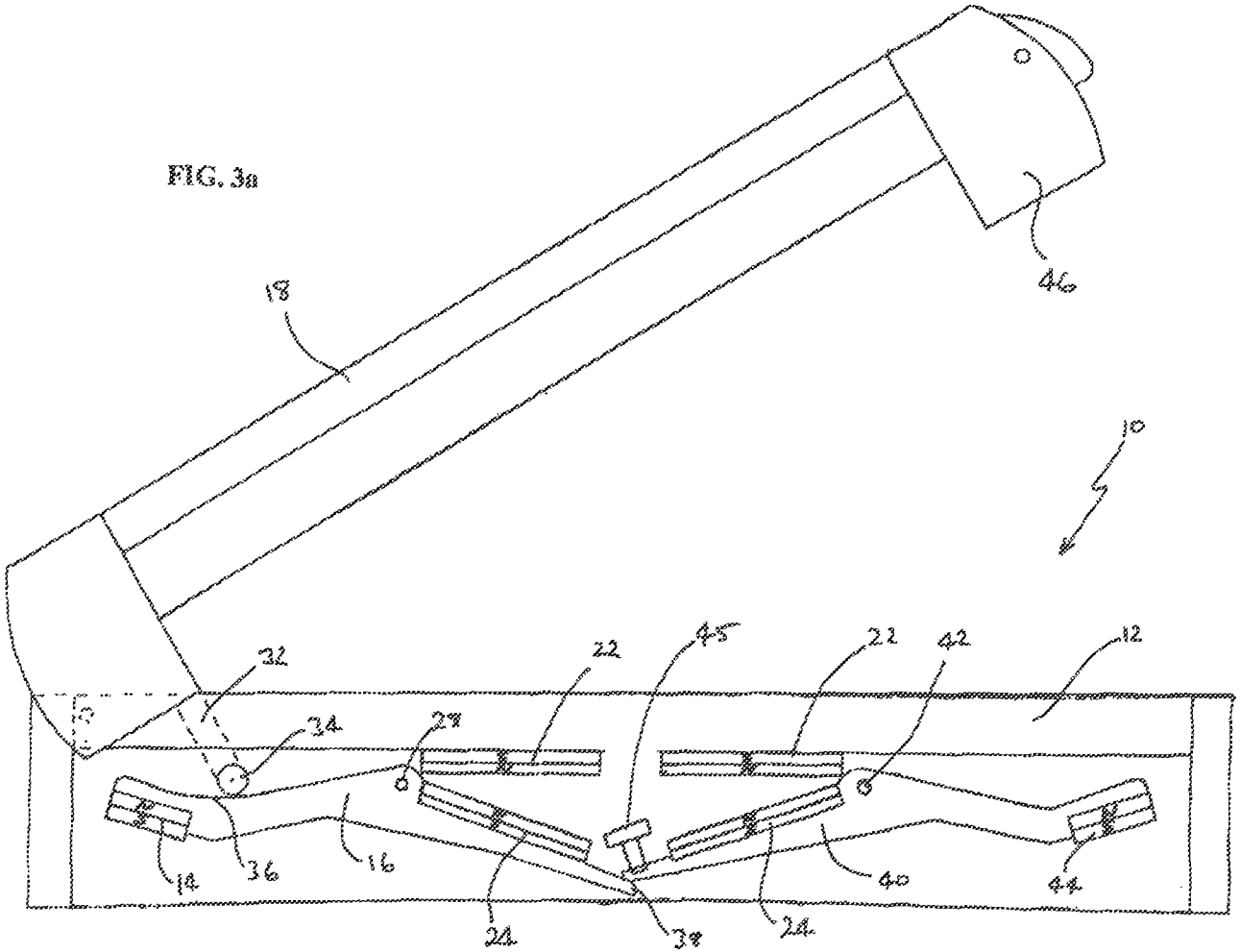
Figure 3B:
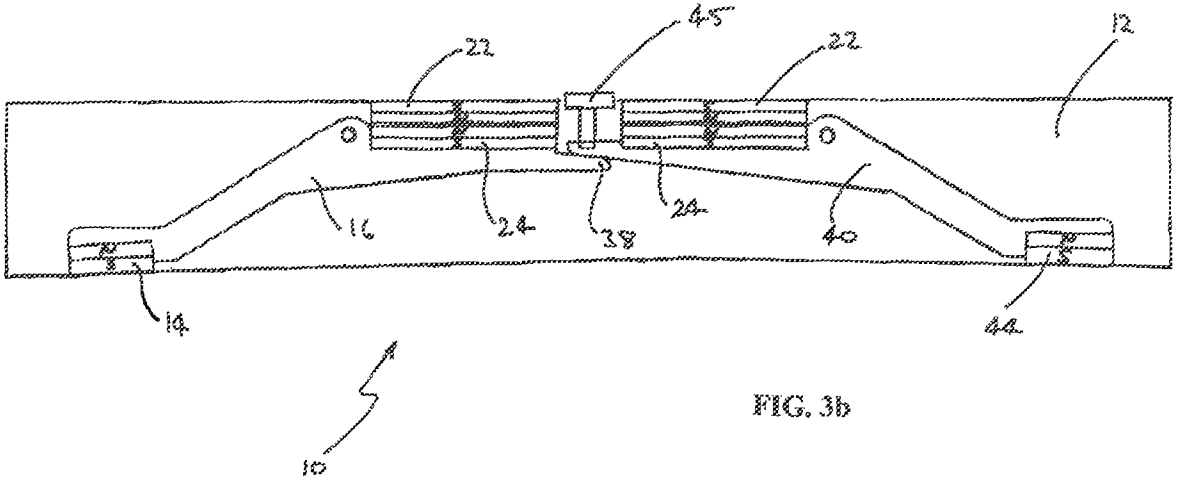
Figure 4:
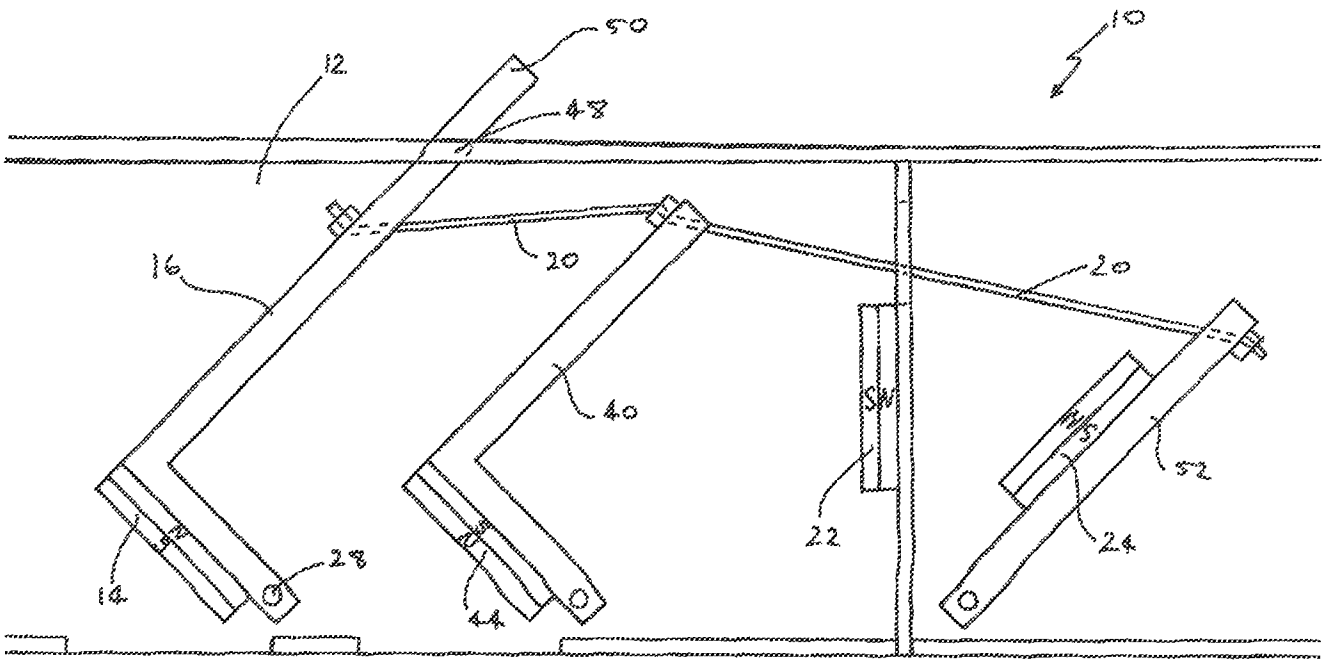
Figure 5A:
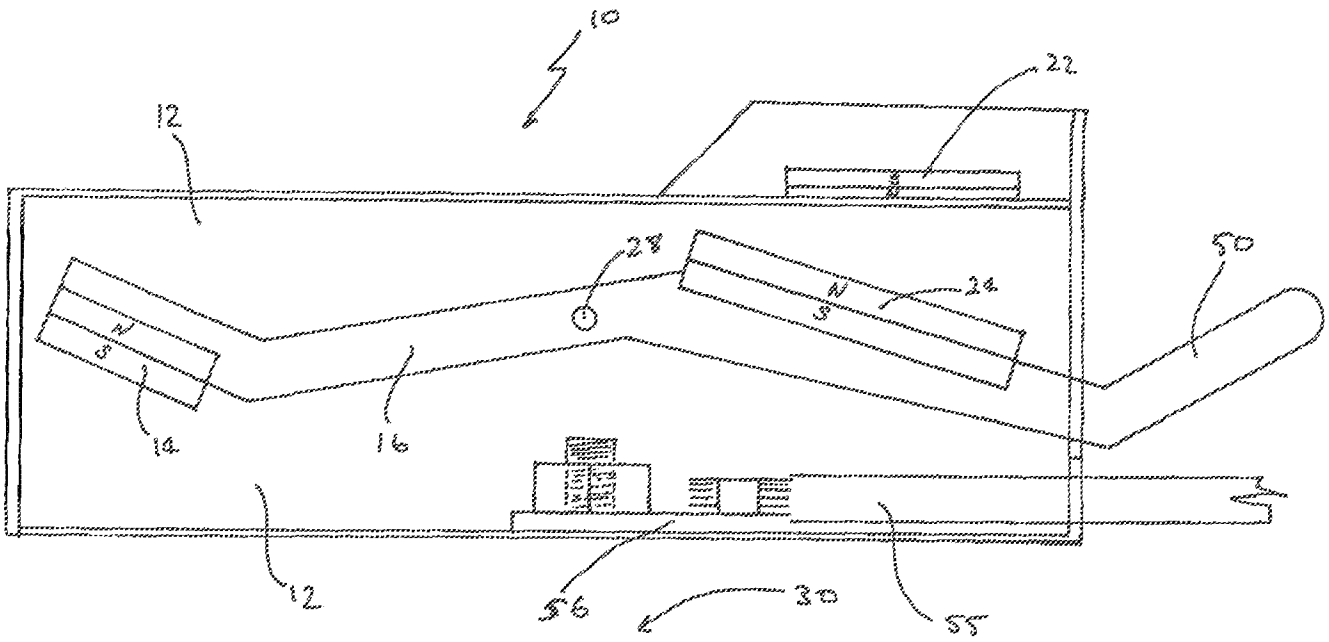
Figure 5B:
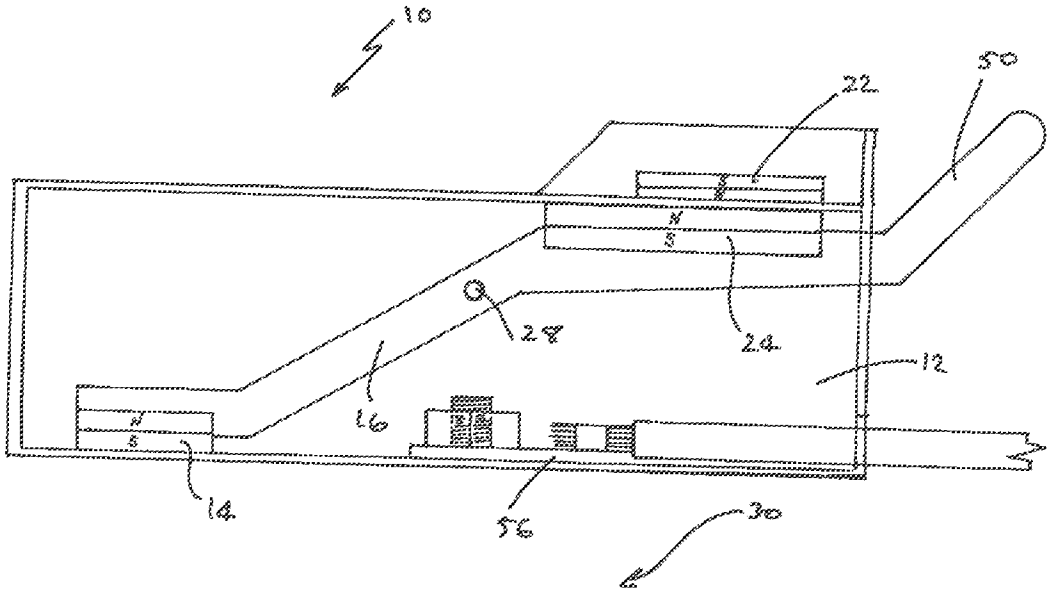
Figure 6A:
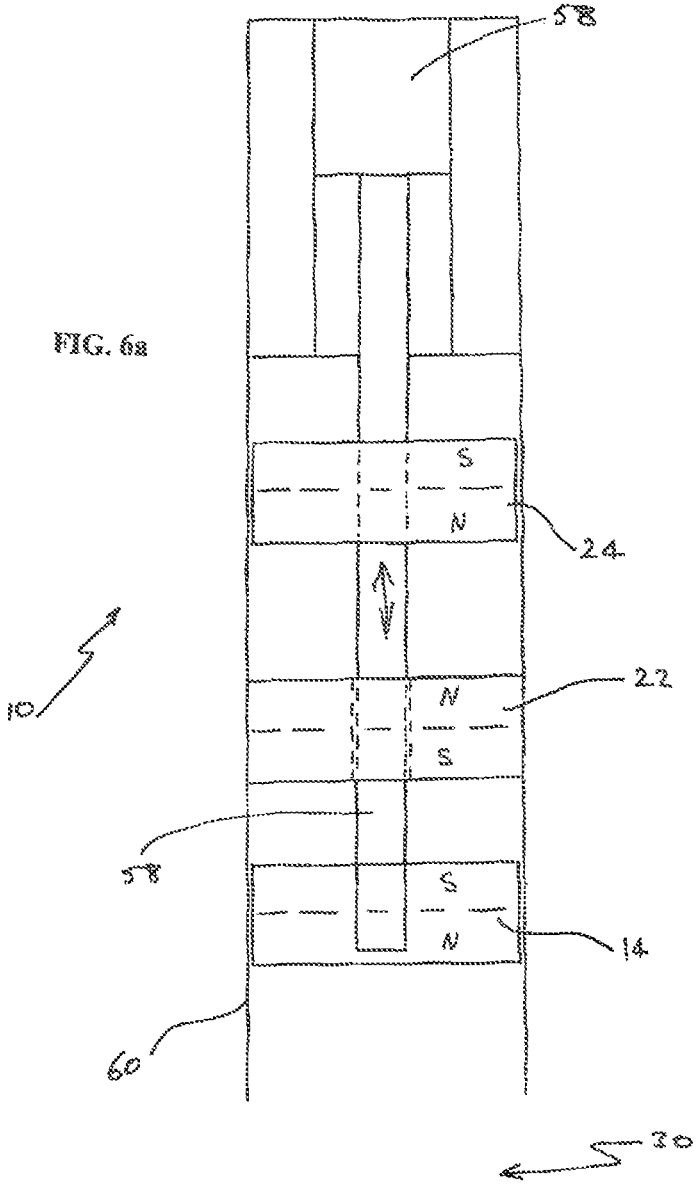
Figure 6B:
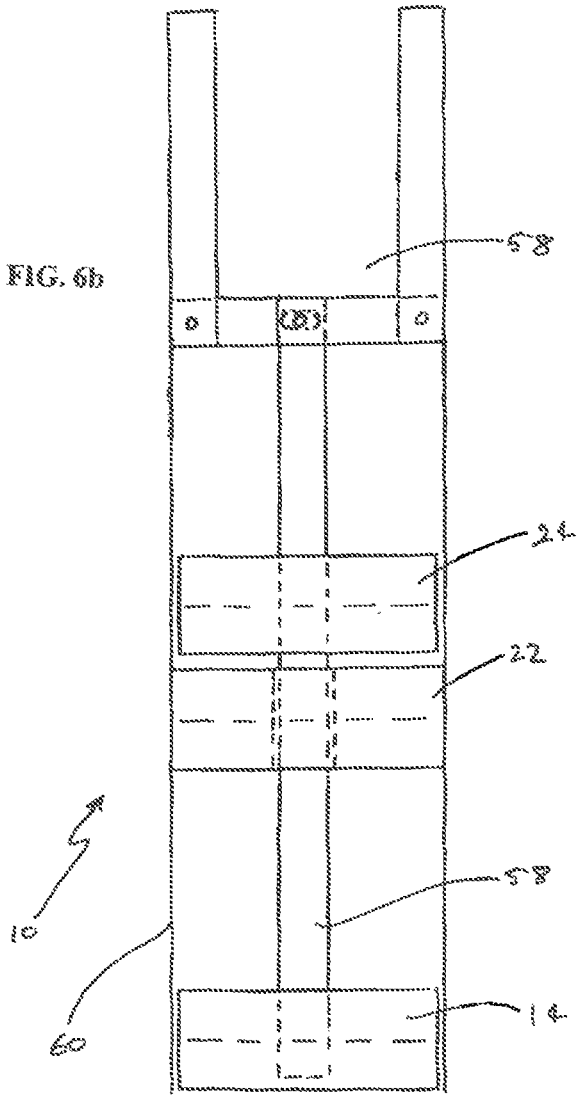
Figure 7:
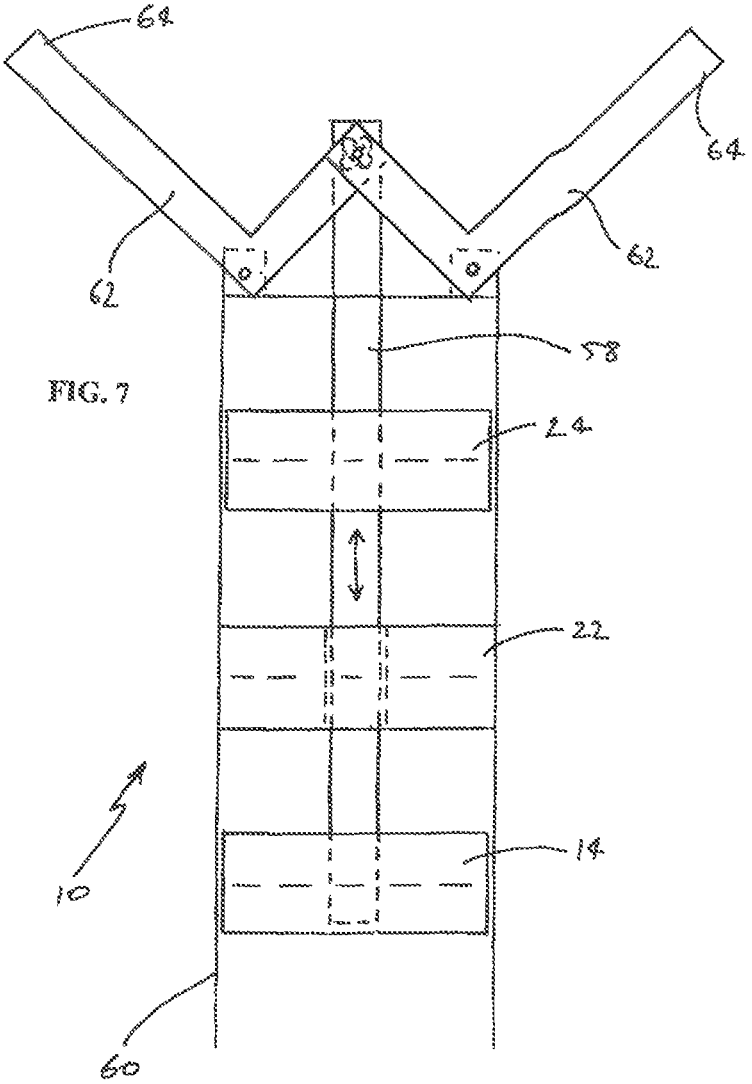

FIGS. 3*a* and 3*b* are diagrammatic views of another clamping device embodied by the invention;

FIG. 4 is a diagrammatic view of another clamping device embodied by the invention;

FIGS. 5*a* and 5*b* are diagrammatic views of another clamping device embodied by the invention;

FIGS. 6*a* and 6*b* are diagrammatic views of a hydraulic clamping device embodied by the invention; and FIG. 7 is a diagrammatic view of yet another clamping device embodied by the invention.

DETAILED DESCRIPTION OF EXEMPLARY EMBODIMENTS OF THE INVENTION

Figure 1:
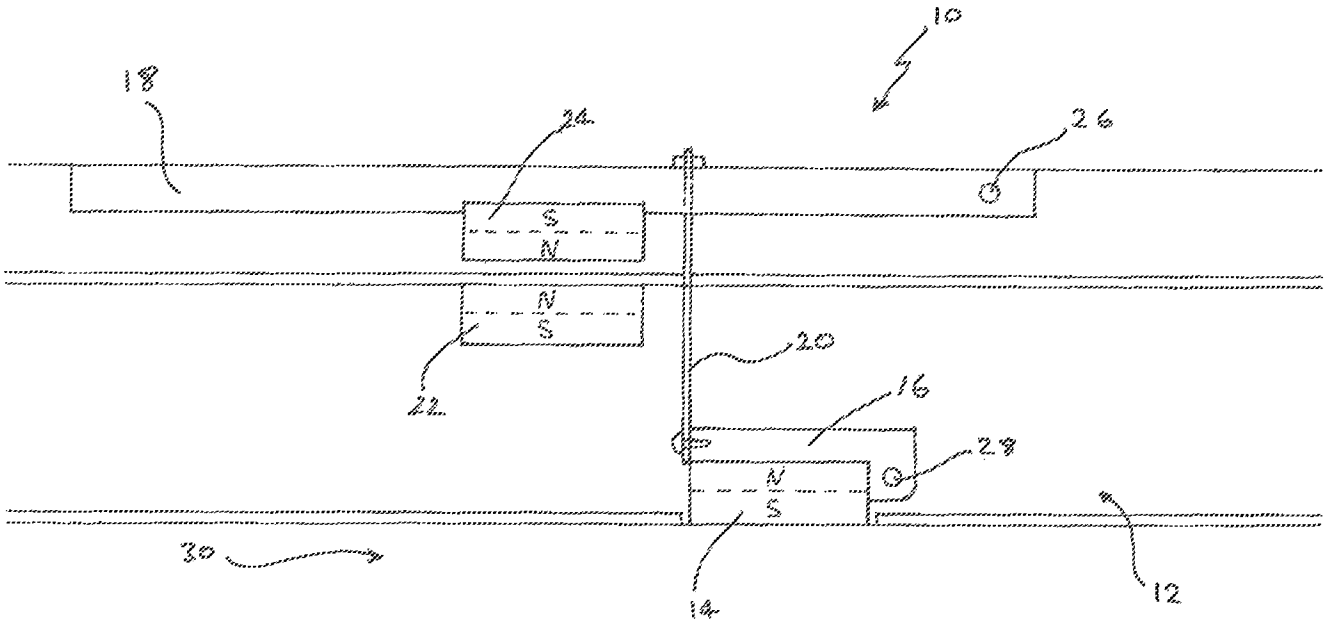
FIG. 1 is a diagrammatic view of a clamping device embodied by the invention with a permanent clamping magnet in its clamping position.

A portable clamping device embodied by the invention is illustrated in FIG. 1. The device comprises a housing fabricated from a non-ferrous material (e.g., a plastics or other suitable material). A permanent clamping magnet 14 is mounted to support means in the form of a clamping lever 16 disposed within the housing. The clamping lever is coupled to a lever arm 18 by a flexible linkage 20. Damping means in the form of repelling magnets 22 and 24 arranged in opposite (i.e., repulsively poled) orientation to repel each other are also provided. One of the repelling magnets 22 is mounted in a fixed position to the housing 12 itself and the other repelling magnet 24 is mounted to the lever arm 18.

Figure 2:
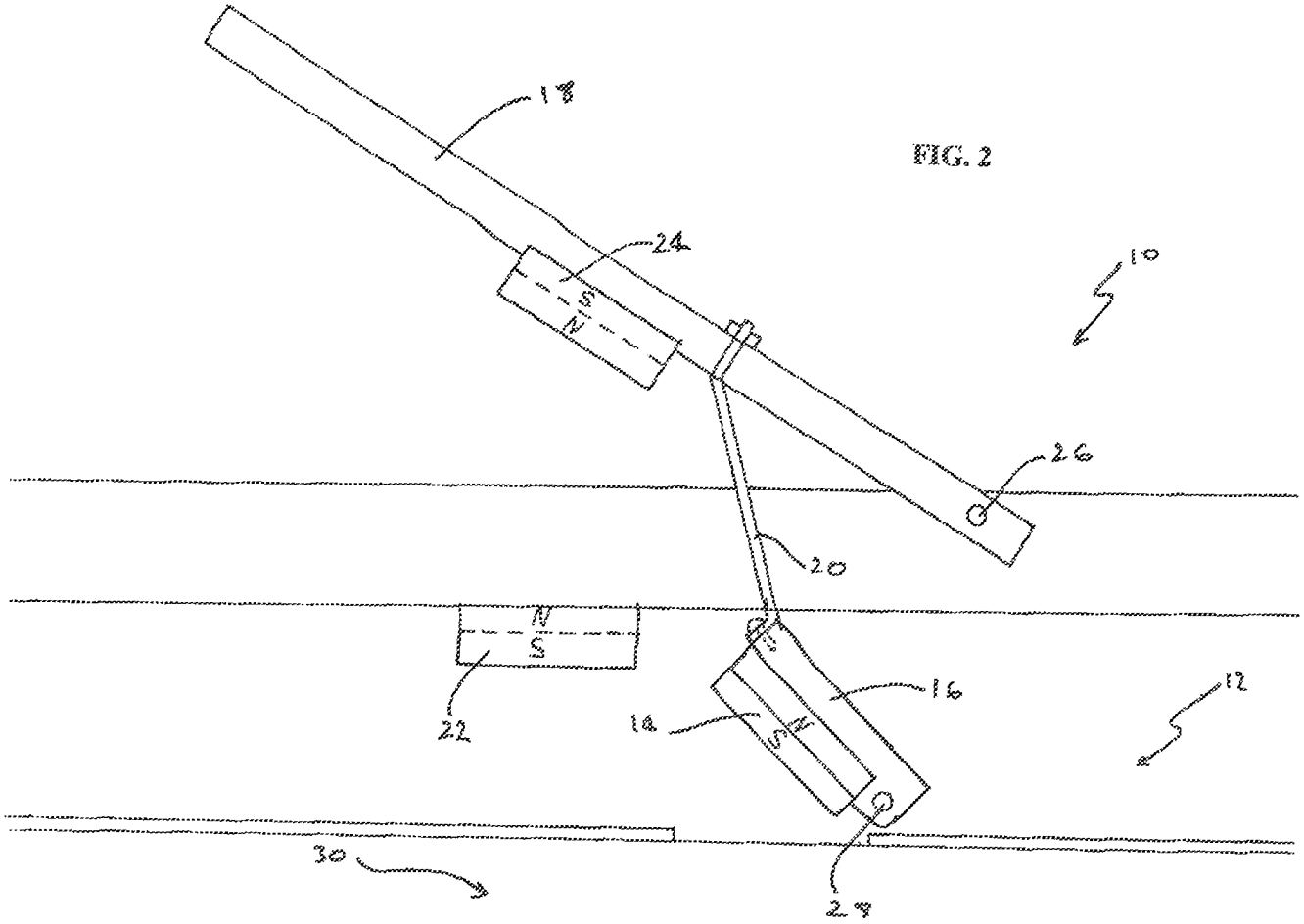
FIG. 2 are diagram tic views of the clamping device of FIG. 1 with the clamping magnet moved to a remote position.

As illustrated in FIG. 2, when the clamping device 10 is operated, the lever arm 18 is rotated about its axis of rotation defined by pivot point 26. Specifically, to raise the clamping magnet 14 from its clamping position shown in FIG. 1, the lever arm 18 is lifted whereby the flexible linkage 20 is tensioned rotating the clamping lever 16 about its pivot point 28 such that the clamping magnet 14 is rotated to a remote position thereby withdrawing the clamping magnet and releasing the device from the metal substrate indicated by the numeral 30. The lifting of the clamping magnet 14 from the metal substrate 30 is facilitated by the magnetically repelling relationship of the repelling magnets 22 and 24. That is, the leverage applied to lift the clamping magnet in combination with the repulsion between the repelling magnets is sufficient to overcome the attraction between clamping magnet and the metal substrate, the force required to release the clamping magnet 14 from the metal substrate 30 being otherwise significantly greater than if the repelling magnets were not provided.

To clamp the clamping device 10 to the metal substrate 30, the device is placed in the desired position on the metal substrate and the lever arm 18 is manually driven downwardly about its pivot point 26 from its release position to its working position. As the lever arm is moved downwardly, the clamping lever 16 is drawn downwardly about its pivot point 28 by attraction of the clamping magnet 14 for the metal substrate. This movement is damped by the repelling relationship of the repelling magnets 22 and 24, the repulsion between the repelling magnets increasing as the gap between the repelling magnets decreases. The repelling magnets 22 and 24 thereby also act to prevent the clamping magnet 14 from "snapping" onto the metal substrate. Whilst in the embodiment illustrated the repelling magnets are disposed in a N-N poled relationship they can in other embodiments, of course, be provided in a S-S poled relationship.

A clamping device 10 of the type shown in FIG. 1 and FIG. 2 can be provided for various applications. For example, the housing can be provided with a handle or grip and the device used as a magnetic lifting device for lifting metal items fabricated from magnetically attracted material (e.g., ferromagnetic metal sheet, bars etc.). In other embodiments, a number of clamping devices 10 may be used to secure a load to a motor vehicle or other metal substrate via a net, rope, tie-downs, tethers, or other suitable fastening system secured to securing means in the form of an external lug, hook, attachment, connector, or the like provided on the housing of respective of the devices.

A clamping device 10 for clamping loads having a relatively low thickness dimension such as fishing rod(s) or snow skies or boards between the lever arm 18 and the housing 12 of the device is illustrated in FIG. 3*a* and FIG. 3*b*. In this embodiment, the lever arm 18 extends substantially the entire length of the housing and has end caps which receive the upper portion of the housing 12 when the lever arm is in its working/closed position. As with the embodiment shown in FIG. 1, the lever arm 18 is pivotally connected at one end to the housing 12. However, in this embodiment, a roller actuator is disposed on the lever arm 18 and acts on the clamping lever 16. The clamping lever 16 has a clamping magnet 14 mounted to one end and a moveable repelling magnet 24 on its opposite end. When the lever arm 18 is manually lowered to its working/closed position, the roller 34 of the roller actuator 32 is rolled rearwardly along the curved surface 26 of the clamping lever causing that lever to pivot about its pivot point 28 whereby the clamping magnet 14 moves downwardly into its clamping position. As the work lever rotates about its pivot point 28, the opposite end tip 38 of the lever 16 initiates rotation of a further like lever 40 upwardly about its pivot point 42 whereby the further clamping magnet 44 of the further lever rotates downwardly to its clamping position as indicated in FIG. 3*b*. At the same time, the moveable repelling magnets 24 of levers 16 and 40 are driven upwardly into a respective magnetically repelling relationship with the corresponding fixed repelling magnets 22, damping the rotation of the clamping magnets 24 and 44 to their clamping positions. When in this position, the roller actuator 32 retains both the clamping lever 16 and the further lever 40 locked in their clamping positions.

To release this clamping device 10 from the relevant metal substrate on which it is placed, the lever arm 18 is raised causing the roller 34 of the roller actuator 32 to be driven forwardly along the clamping lever 16 back to its starting position. The clamping lever 16 does not move and the clamping magnet 14 remains in its clamping position. Release means in the form of a release button 45 is then operated by manual depression of the button. The depression of the button exerts enough force on the overlapping tips 38 of the further lever 40 and the clamping lever to initiate rotation of the levers in opposite directions about their respective pivot points to lift the clamping magnets 14 and 44 from the metal substrate 30. Besides assisting to lift the clamping magnets from their clamping positions, the repulsion between repelling magnets 22, 24 associated with each respective lever 16 and 40 also then acts to drive the return of the clamping lever 16 and further lever back to their starting positions whereby the clamping magnets 14 and 44 are also withdrawn to their respective initial positions remote from the metal substrate.

To avoid or reduce the possibility of scratching or other damage to the load, a respective retainer insert fabricated from a suitable plastics material (e.g., polyurethane, polyvinyl chloride, polyethylene, polypropylene etc.) is provided on each of the housing and the lower side of the lever arm 18 to clamp the load therebetween when the lever arm 18 is in its working/closed position.

To secure the lever arm 18 of embodiments of the above described types in its closed position, the clamping device is provided with a locking mechanism (e.g., a press and/or key operated latching system). Various types of locking mechanisms are known in the art and any suitable conventionally known such system may be utilised. For example, the free end 46 of the lever arm 18 can be provided with a hasp or the like which engages a latching mechanism provided on the housing when the lever arm 18 is moved from its release position to its working/closed position.

For embodiments of devices in accordance with the invention that are provided for clamping a load to the roof of a motor vehicle, the base of the housing typically has a curvature substantially matching that of the roof of the vehicle so that the device is seated flushly when placed on the roof. Likewise, in other applications where a device in accordance with the invention is provided for clamping to a non-planar surface of a metal substrate, the base of the device may be contoured to substantially match that of the substrate.

Another embodiment of a clamping device 10 of the invention is illustrated in FIG. 4. In this embodiment, an end of the clamping lever 16 protrudes through a slot 48 defined in the top of the housing 12 thereby providing a handle 50 for operation of the clamping lever. The clamping lever again pivots about pivot point 28 whereby the clamping magnet 14 is rotated about the axis of rotation defined by the pivot point from a position remote from the metal substrate to a clamping position of the clamping magnet 14. In this embodiment, as illustrated, the clamping lever 16 is coupled to a further lever 40 to which a further clamping magnet is mounted by a flexible linkage 20. The further lever 40 is in turn coupled to a slave lever 52 by the linkage 20. As such, when the handle 50 of the clamping lever 16 is manually operated to magnetically clamp the device 10 in position on the metal substrate, the further lever 40 is rotated with the clamping lever 16 about its pivot point. As the slave lever 52 is rotatably drawn about its pivot point by the linkage 20, the movable repelling magnet 24 mounted to that lever is drawn into a magnetically repelling relationship with the fixed repelling magnet 22 thereby damping the movement of the clamping magnets 14 and 44 into their respective clamping positions.

Lifting the handle 50 in the opposite direction lifts clamping magnet 14 from its clamping position whereby the repulsion between the repelling magnets 22 and 24 drives them apart causing the slave lever to pivot about it pivot axis. In turn, the further lever 40 (and the clamping lever 16) is rotatably drawn by the linkage 20 with the rotation of slave lever about its pivot point. The clamping magnets 14 and 44 are thereby withdrawn from their clamping positions. That is, the magnetic attraction by the clamping magnets 14 and 44 for the metal substrate 30 when in their clamping positions is sufficient to retain the repelling magnets in a magnetically repelling relationship. When the protruding handle 50 of the clamping lever 16 is manually operated to release the clamping device from the metal substrate thereby at least partially raising the clamping magnet 14, the repulsion between the magnetically repelling magnets becomes dominant and drives rotation of the slave lever 52 away from the fixed repelling magnet 22 whereby the linkage 20 draws further lever 40 (and the clamping lever 16) about its pivot point lifting/withdrawing the clamping magnet 44 (and clamping magnet 14).

Still another embodiment of a clamping device 10 in accordance with the invention is illustrated in FIG. 5*a* and FIG. 5*b*. In this instance, the clamping device shown is a welding earth clamp with an earth lead 55 is coupled to a lug 56 provided on the floor of the housing for electrical contact with a metal substrate in the form of a steel work bench or the like. As with the embodiment shown in FIG. 4*a*, an end of the clamping lever 16 projects through a slot in the housing forming a handle 50 for being manually operated to lower or raise the clamping magnet 14 into or from its clamping position under the damping/repelling action of the repelling magnets 22 and 24.

Clamping devices of the type illustrated in FIG. 4 and FIGS. 5*a* and 5*b* may also be provided with a locking mechanism as for the embodiments shown in FIG. 1 and FIG. 2, for locking the handle 50 in its working closed position to the housing for retention of the clamping magnet(s) in their clamping position. Such locking mechanisms are well within the ordinary skill of the addressee.

Rather than repelling magnets, the damping means of a clamping device 10 embodied by the invention can comprise any suitable means for biasing respective of the clamping magnet(s) away or a from their clamping position such as a suitable compression or tension spring, or a stop formed from resilient plastics material. However, over time the elastic "memory" of such other damping means may decrease to a level wherein the damping effect provided and the assistance exerted to effect withdrawal of respective of the clamping magnets from their clamping position reduces to an inadequate level.

As will be understood, the degree of damping/repelling provided by the repelling magnets 22 and 24 of an embodiment of the invention is determined by the strength of the magnets and the distance between the movable and fixed repelling magnets when the corresponding clamping magnet 14 is in its clamping position.

A clamping device 10 embodied by the invention may be provided with a plurality of clamping levers 16. For example, the clamping levers 16 may be arranged in a radial relationship for being operated to move their respective clamping magnets 14 to, and from, respective clamping positions. In these embodiments, the clamping levers may be pivotally mounted around a central hub, each clamping lever 16 being mounted/coupled to support means in the form of a ring or plate by a respective linkage such that when the plate or ring is driven toward the hub or withdrawn therefrom, the respective clamping magnets 14 of the clamping levers 16 are moved to, or withdrawn from, their respective clamping positions. Repelling magnets 24 can be mounted on the plate or ring so as to be moved into magnetically repelling relationships with fixed repelling magnet(s) 22 provided on the hub to dampen the movement of the clamping magnets 14 to their clamping positions as the plate/ring travels toward the hub and to exert a release force on the clamping magnets to withdraw the clamping magnets from their clamping positions when the drive plate is moved in the opposite direction. The drive plate/ring can be moved toward, or away from, the hub via manually operated lever and/or linkage system or other suitable system.

Whilst clamping devices in accordance with the invention may in many applications be manually operated the invention is not limited thereto. Indeed, the support means on which respective of the clamping magnet(s) is/are mounted for movement of the clamping magnet(s) 14 of a device embodied by the invention into or from their clamping positions may be a hydraulically or pneumatically operated actuator (e.g., a ram) rather than clamping lever 16, and/all alternate such embodiments are expressly encompassed herein.

An example of a hydraulic clamping device 10 embodied by the invention and which is suitable, for instance, for use as a lifting device is shown in FIG. 6*a* and FIG. 6*b*. In this instance, the device 10 comprises support means in the form of a hydraulically operated ram 58 to which is mounted clamping magnet 14 and a movable repelling magnet 24. A fixed repelling magnet 22 is mounted to the body/housing of the device indicated by the numeral 60 in a stationary position. In use, the hydraulic ram is operated to drive the movable repelling magnet 24 into a repelling relationship with the fixed magnet 22. At the same time, the clamping magnet 14 is moved forwardly away from the fixed magnet into a clamping position to magnetically clamp a metal substrate 30 on which the device is placed in use. Whilst the attraction of the clamping magnet for the metal substrate can draw along and so extend the ram 58, the repulsion between the repelling magnets damps the movement of the clamping magnet to its clamping position. To release the metal substrate, the hydraulic ram is operated in the opposite direction to initially overcome the attraction of the clamping magnet for the metal substrate, whereby the repulsion between the repelling magnets assists the return of the ram 58 to its starting position. As also shown, there is magnetic repulsion between the clamping magnet 14 and the repelling magnet 22. This assists extension of the ram 58 and also damps the retraction of the ram. As an alternative, this device can instead be pneumatically operated. In either case, a significantly greater amount of hydraulic or pneumatic force would be required to separate the metal substrate/load from the clamping magnet. This type of device can, for example, be provided with a clamping magnet having a diameter of about 300 mm and a thickness of 150 mm for lifting a load of up to 5 tonnes or more.

A variation of the device shown in FIG. 6*a* and FIG. 6*b* is shown in FIG. 7. In this case the device has hinged levers 62 with handles indicated by the numerals 64 for being manually (or otherwise) moved toward or away from one another for extension or retraction of the ram 58.

The clamping magnets 14 and repelling magnets 22 and 24 of an embodiment of the invention are typically permanent rare earth magnets, which may be the same or different to one another. Particularly suitable rare earth magnets which may be utilised include neodymium (neodymium, iron and boron) magnets and samarium-cobalt magnets.

The housing 12 in which the clamping magnets 14 of the clamping device are disposed can be provided with a floor e.g., in the form of a panel or flexible covering fabricated from a suitable plastics material (e.g., high density polyethylene (HDPE), polyurethane or the like) to avoid or minimise the risk of unintentional scratching when the clamping device is used on a metal substrate having a painted, coated or prepared surface. In other embodiments, such as when the clamping device 10 is a welding earth clamp, the floor of the device can be fabricated from a suitable electrically conductive metal. However, it is not necessary that the clamping magnets be entirely enclosed in the housing 12. Indeed, the floor of the housing may be at least partially open in at least some embodiments whereby the clamping magnet(s) are in direct contact with the magnetically attracted material to which they are clamped in use. Examples of this may include at least some forms of clamping device 16 used for lifting purposes (e.g., a hand held such device or a lifting device for a crane).

In particularly preferred embodiments, a clamping device 10 in accordance with the invention can further comprise an alarm system configured to provide an alarm signal when the clamping magnet(s) have been moved to their respective clamping positions but have not been "locked" against withdrawal from the metal substrate by the locking mechanism of the clamping device. Alternatively, or as well, the alarm system may provide an alarm signal indicative of "lifting" or potential for lifting of the clamping magnet(s) from the metal substrate as may be determined by a change in magnetic field strength between the clamping magnet(s) and the metal substrate (e.g., utilising a Hall effect switch and/or or other magnetic field strength sensor(s)). The alarm system can, for example, comprise a power source (e.g., a battery) and/or piezoelectric alarm circuit(s), signal emitting means (e.g., for emitting light and/or sound alarm signals such as light emitting diode(s) and/or alarm speaker(s)). Accordingly, the alarm signal(s) can be visual and/or audible alarm(s).

The magnetically attracted material from which the metal substrate 30 is fabricated can be any material which is magnetically clamped by the permanent clamping magnets 14 such as mild steel or other ferromagnetic material.

Whilst in the embodiments described above, the clamping magnets are at least initially moved into their respective clamping positions by manual or like operation of the clamping lever(s) 16 (or other actuator), embodiments may be provided in which the clamping magnets move automatically into their clamping positions under the action of the attractive magnetic force between the clamping magnets and the metal substrate. In this instance the clamping lever 16 (or other support means) can move automatically under the action of the magnetic attraction of the clamping magnet(s) 14 for the metal substrate and may, for instance, be operated (e.g., manually) to withdraw the clamping magnet(s) 14 from its/their clamping position to release the clamping magnet from the metal substrate.

Further applications for which clamping device(s) described herein can be provided or for which they may be utilised include motor vehicle racks for a surfboard, canoe or the like, window and door locks, a holding device for equipment, an attachment device for a solar panel on metal roof sheeting, magnetic sweepers (e.g., for workshops or aircraft runways), manhole lifters and magnetic tethers (in marine environments, both above and below the water), and replacement devices for electromagnets for picking up scrap metal or other metal items. Respective of the clamping devices provided with handles and/or securing means as described above where applicable for the intended purpose of the device.

Although a number of embodiments of the invention have been described above, it will be understood that various modifications and changes may be made thereto without departing from the scope of the invention. Hence, the embodiments described above are only illustrative and not to be taken as being restrictive.

The invention claimed is:

1. A magnetic clamping device for magnetically clamping to a magnetically attracted material, comprising:

at least one permanent clamping magnet for magnetically clamping to the magnetically attracted material, the magnet being movable relative to the magnetically attracted material from a position remote from the magnetically attracted material to a clamping position for the clamping of the material by the magnet;

damping means for damping the movement of the clamping magnet to the clamping position, the damping means biasing the clamping magnet away from the magnetically attracted material to assist release of the clamping magnet from the magnetically attracted material; and support means to which the clamping magnet is mounted for said relative movement of the clamping magnet from the remote position to the clamping position and for withdrawing the clamping magnet relative to the magnetically attracted material to release the magnetically attracted material, wherein the damping means comprises repelling magnets arranged for being moved relative to one another into a magnetically repelling relationship with each other to dampen the movement of the clamping magnet into the clamping position.

2. The device according to claim 1 wherein the repelling magnets comprise at least one moveable magnet and at least one fixed magnet, the moveable magnet being arranged to be moved into the magnetic repelling relationship with the fixed magnet with said movement of the clamping magnet relative to the magnetically attracted material.

3. The device according to claim 1 wherein the support means is arranged for said movement of the clamping magnet from the remote position to the clamping position by magnetic attraction of the clamping magnet for the magnetically attracted material.

4. The device according to claim 1 wherein the support means comprises a ram operable to withdraw the clamping magnet relative to the magnetically attracted material for release of the magnetically attracted material from the clamping magnet.

5. The device according to claim 1 wherein the support means comprises a clamping lever rotatable about a pivot axis from a release position to a working position for clamping of the magnetically attracted material by the clamping magnet.

6. The clamping device according to claim 5 further comprising a lever arm for being manually pivoted about an axis of rotation from a release position to a working position for rotation of the clamping lever about its pivot axis to move the clamping magnet to its clamping position.

7. The device according to claim 6 wherein the arm is connected to the clamping lever by a linkage.

8. The device according to claim 6 further comprising an actuator disposed on the arm and which is arranged for being driven along the clamping lever for operation of the clamping lever.

9. The device according to claim 5 comprising at least one further lever and at least one further said permanent clamping magnet mounted to the further lever, the further lever being rotatable by operation of the clamping lever to move the further clamping magnet from a position remote from the magnetically attracted material to a clamping position to magnetically clamp the magnetically attracted material.

10. The device according to claim 9 wherein the further lever is arranged for being manually depressed for return of the further lever about its pivot axis.

11. The device according to claim 2 wherein the device comprises a housing and support means comprises a clamping lever rotatable about a pivot axis from a release position to a working position for clamping of the magnetically attracted material by the clamping magnet, and the clamping lever is disposed in the housing.

12. The device according to claim 11 wherein the fixed magnet is mounted to the housing.

13. The device according to claim 11 wherein the clamping magnet is mounted to one end region of the clamping lever and the moveable magnet is mounted to an opposite end region of the clamping lever.

14. The device according to claim 1 wherein the repelling magnets are permanent magnets.

15. The clamping device according to claim 1 further comprising a locking mechanism for being operated to lock the at least one said clamping magnet in its said clamping position.

16. The clamping device according to claim 1 selected from the group consisting of a securing device for securing a load, a lifting device, a device for holding a work piece in position, and a welding earth clamp.

17. A method for clamping a clamping device to a magnetically attracted material, comprising:

(1) providing the clamping device, the device having:

(a) at least one permanent clamping magnet for magnetically clamping to the magnetically attracted material, the magnet being movable relative to the magnetically attracted material from a position remote from the magnetically attracted material to a clamping position for the clamping of the material by the magnet;

(b) damping means for damping the movement of the clamping magnet to the clamping position; and (c) support means to which the clamping magnet is mounted for said relative movement of the clamping magnet from the remote position to the clamping position and for withdrawing the clamping magnet relative to the magnetically attracted material to release the magnetically attracted material;

(2) locating the clamping device in position in relation to the magnetically attracted material; and (3) magnetically clamping the magnetically attracted material with movement of the clamping magnet relative to the magnetically attracted material from said remote position to the clamping position, the damping means biasing the clamping magnet away from the magnetically attracted material to assist release of the clamping magnet from the magnetically attracted material, wherein the damping means comprises repelling magnets and the repelling magnets are moved relative to one another into a magnetically repelling relationship with each other to dampen the movement of the clamping magnet into the clamping position.

18. The method according to claim 17 wherein the repelling magnets comprise at least one moveable magnet and at least one fixed magnet, and the moveable magnet is moved into the magnetic repelling relationship with the fixed magnet with said movement of the clamping magnet relative to the magnetically attracted material.

19. The method according to claim 17 wherein the clamping magnet is moved from the remote position to the clamping position by magnetic attraction of the clamping magnet for the magnetically attracted material.

20. The method according to claim 17 wherein the support means comprises a hydraulic ram and the hydraulic ram is operated to withdraw the clamping magnet relative to the magnetically attracted material for release of the magnetically attracted material from the clamping magnet.

21. The method according to claim 17 wherein the support means comprises a clamping lever and the clamping lever is rotated about a pivot axis from a release position to a working position for the clamping magnet to clamp the magnetically attracted material.

22. The method according to claim 17 wherein the clamping device is selected from the group consisting of a securing device for securing a load, a lifting device, a device for holding a work piece in position, and a welding earth clamp.

* * * * *